US005160548A

United States Patent [19]

Boisture

[11] Patent Number: 5,160,548

[45] Date of Patent: Nov. 3, 1992

[54] METHOD FOR CLEANING TUBE BUNDLES USING A SLURRY

[75] Inventor: Thomas B. Boisture, Baytown, Tex.

[73] Assignee: Ohmstede Mechanical Services, Inc., Baytown, Tex.

[21] Appl. No.: 756,616

[22] Filed: Sep. 9, 1991

[51] Int. Cl.[5] ..... B08B 9/02; B24C 1/00

[52] U.S. Cl. ..... 134/7; 134/8; 134/22.11; 134/22.12; 51/317; 51/319

[58] Field of Search ..... 134/6, 7, 8, 22.12, 134/22.18, 32; 51/317, 290, 319

[56] References Cited

U.S. PATENT DOCUMENTS

| | | | |
|---|---|---|---|
| 2,745,231 | 5/1956 | Prince | 51/317 |
| 3,824,738 | 7/1974 | Hall et al. | 51/319 |
| 4,380,477 | 4/1983 | Saunders | 134/8 |
| 4,583,329 | 4/1986 | Lang | 51/319 |
| 4,802,312 | 2/1989 | Glaeser et al. | 51/319 |

*Primary Examiner*—Theodore Morris
*Assistant Examiner*—Saeed Chaudhry
*Attorney, Agent, or Firm*—Pravel, Gambrell, Hewitt, Kimball & Krieger

[57] ABSTRACT

A method for cleaning the interior wall of a tube with a slurry and a tubular lance. The method includes the steps of inserting an end of the tubular lance into the tube and pumping a fluid through the tubular lance into the tube. A slurry is pumped into the interior of the tube between the tubular lance and the interior of the tube. The slurry mixes with the fluid at the end of the tubular lance in the tube and the slurry and fluid mixture is propelled against the interior tube wall at the end of the tubular lance to clean the interior wall of the tube.

9 Claims, 1 Drawing Sheet

METHOD FOR CLEANING TUBE BUNDLES USING A SLURRY

BACKGROUND OF THE INVENTION

1. Field of the Invention

The present invention relates generally to a method for cleaning the interior wall of tubes used in heat exchanger bundles, and more particularly to an improved method of cleaning the interior wall of a tube with a slurry and a tubular lance.

2. Description of the Prior Art

Heat exchanger tube bundles are used for the transfer of heat from a fluid media passing through a series of conduits or tubes. During this process, carbonaceous and calcareous deposits will form on the interior of the individual tubes and debris and other dirt will collect on the surface of the individual tubes. Therefore, in order to maintain efficient operation, it is necessary to periodically remove the tube bundles and clean the interior and exterior of the tubes.

One primary method of cleaning the interior of heat exchanger tubes includes the progressive insertion of a small diameter tube, known as a lance, having a nozzle with a plurality of jets at the leading end of the lance. As the nozzle-end of the lance is progressively inserted into the heat exchanger tube, a high pressure fluid, typically water, is pumped through the lance and the nozzle to clean the interior wall of the tube. The water pressure in the lance may easily exceed 10,000 pounds per square inch (psi) with flow rates in excess of 100 gallons per minute (gpm).

In many instances the carbonaceous and calcareous deposits are not easily removed by the above-described process and a single cleaning operation of the lance and high pressure water will not be adequate. Thus, it may be necessary to perform the cleaning operation several times to adequately remove stubborn deposits. Occasionally, the stubborn deposits are not removed after several attempts employing this process. Obviously, the efficiency and capability of cleaning several hundred tubes in a single heat exchanger bundle is greatly affected when it is necessary to perform multiple cleaning operations on individual tubes.

An alternative method of cleaning tubes having stubborn deposits is to dry sand blast the interior wall of the tube. Dry sand is blasted at the open end of the tube and is adequate for removing stubborn deposits near the end of the tube at which the sand enters the tube, but is inadequate along more distant sections of the tube due to the decreased velocity and impingement of the sand grains with the wall of the tube.

Accordingly, there exists a need for an improved method of cleaning the interior of tubes in a heat exchanger tube bundle in which a slurry can be propelled against the wall of the tube to remove stubborn deposits.

SUMMARY OF THE INVENTION

The present invention relates to a method for cleaning the interior of tubes within a heat exchanger bundle with a slurry and a tubular lance. The method includes the steps of inserting the end of the tubular lance having a nozzle attached thereto into the tube and pumping a high pressure fluid, such as water, through the tubular lance and nozzle. A slurry is pumped at low pressure into an annular area formed between the tubular lance and the interior wall of the tube. The slurry mixes with the high pressure fluid at the end of the tubular lance in the tube and the high pressure fluid propels the slurry and fluid mixture against the interior wall of the tube to clean the tube. The tube being cleaned is both a conduit for the slurry and a mixing chamber for the slurry and high pressure fluid. The high pressure fluid acts as a motive force to accelerate the slurry and causes the slurry to impinge on the interior wall of the tube at any point along the length of the tube.

BRIEF DESCRIPTION OF THE DRAWINGS

A better understanding of the present invention may be had by reference to the following drawings and contained numerals therein of which.

DETAILED DESCRIPTION OF THE INVENTION

Figure 1:
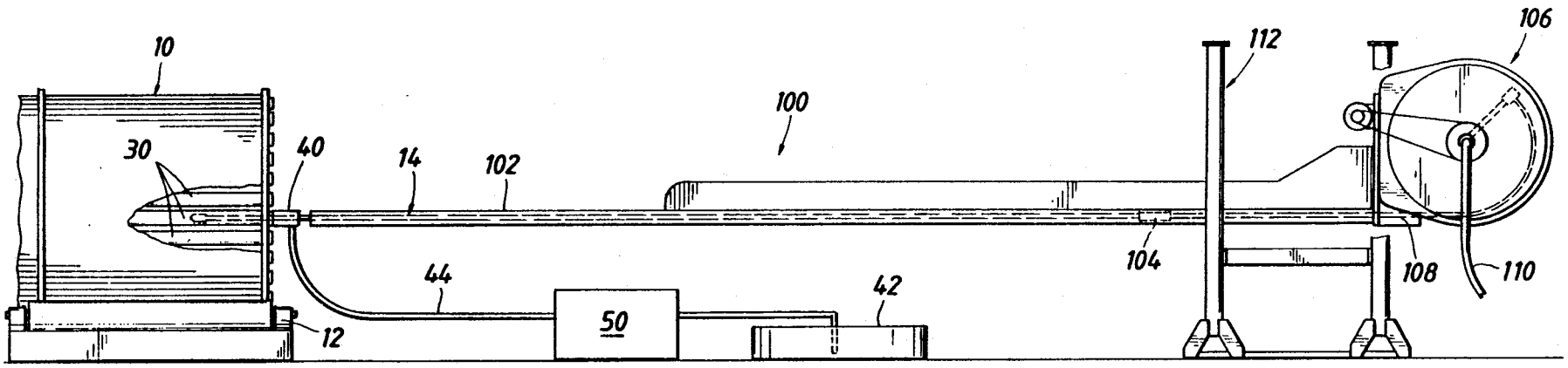
FIG. 1 is an elevational view of a typical heat exchanger tube cleaning system and tube bundle according to the present invention.
Figure 2:
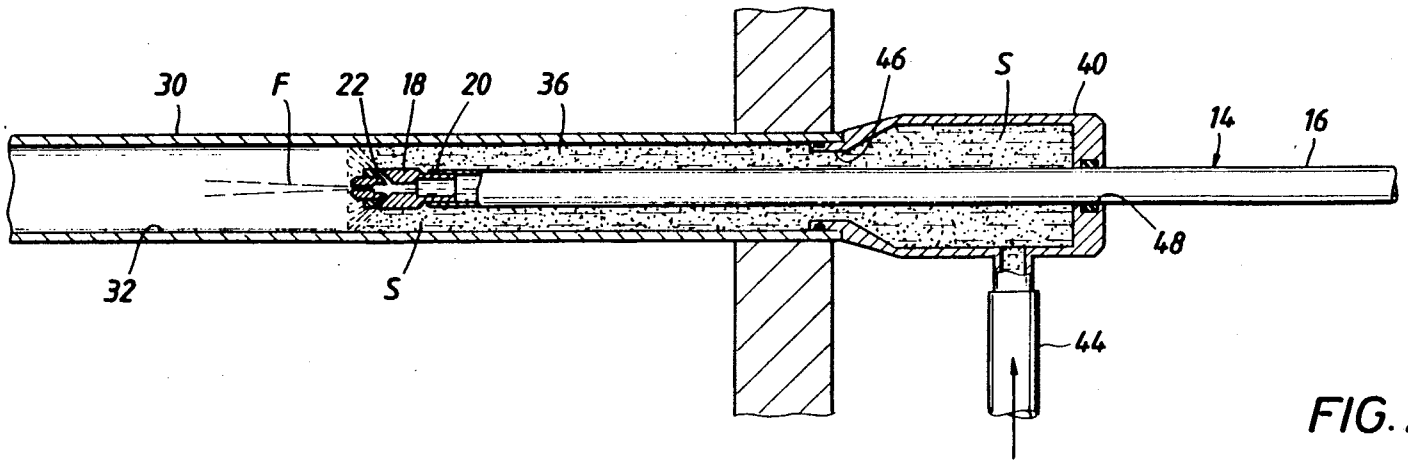
FIG. 2 is an enlarged cross-sectional view of a portion of FIG. 1 showing a tube being cleaned by the method of the present invention.

FIG. 1 is an elevational view of a typical heat exchanger tube cleaning system 100 and a tube bundle 10. The tube bundle 10 is shown in FIG. 1 disposed on rollers which are part of a tube bundle support and rotating device 12. The tube bundle support and rotating device 12 is disclosed in U.S. Pat. No. 5,018,544, which disclosure is hereby incorporated by reference and made a part hereof. With reference also to FIG. 2, the tube bundle 10 includes a plurality of tubes 30 which have an interior wall 32 which periodically require cleaning as a result of carbonaceous and calcareous deposits forming on the interior wall 32. The heat exchanger tube cleaning system 100 as shown in FIG. 1 includes an elongate housing 102 which encloses one or more lance assemblies 14 and a moveable high pressure fluid manifold 104 within the housing 102 which is connected to the lance assembly 14. The system 100 is more fully described in U.S. Pat. No. 5,002,120, which disclosure is hereby incorporated by reference and made a part hereof. With reference to FIG. 1, a spool assembly 106 is used to store a high pressure flexible water conduit 108 which is in fluid communication with the manifold 104. The flexible water conduit 108 of the spool assembly 106 is connected to a high pressure, high volume fluid source (not shown) by means of a hose 110. The lance assembly 14, elongate housing 102 and the spool assembly 106 are supported by a positioner assembly 112 which supports and positions the lance assembly 14, elongate housing 102 and the spool assembly 106 relative to the tube bundle 10 to be cleaned. The positioner assembly 112 is capable of moving the lance assembly 14, elongate housing 102 and spool assembly 112 horizontally (or laterally) and vertically. A detailed description of one embodiment of the positioner assembly 112 which can be used with the present invention is included in U.S. Pat. No. 5,002,120. The spool assembly 106 is motor driven to advance the lance assembly 14 into a tube 30 or to withdraw the lance assembly 14 from the tube 30.

In FIG. 1, the lance assembly 14 is shown partially inserted in the tube 30 of the tube bundle 10. As shown in FIG. 2, the lance assembly 14 includes a tubular lance 16 and a nozzle 18 attached to an end 20 of the tubular lance 16. The tubular lance 16 is hollow to permit a fluid F to be pumped into and through the tubular lance 16. The tubular lance 16 is in fluid communication with the high pressure, high volume fluid source (not shown) which provides high pressure fluid F to the tubular lance 16. The fluid F is meant to include water, a cleaning fluid, or any soluble combination thereof. The lance 16 has a relatively thin wall and is manufactured from a high strength stainless steel or other suitable material.

As shown in FIG. 2, the nozzle 18 threadably engages the end 20 of the lance 16. The nozzle includes jets 22 which direct the fluid F in a radial direction forward of the lance assembly 14. It is desirable to have a nozzle 18 that sprays a substantially cone-shaped jet in order that substantially the entire circumference of the interior wall 32 is cleaned of debris.

As shown in FIG. 1, a slurry housing 40 is connected to a slurry tank 42 by a slurry hose 44. A pump 50 is provided to pump a slurry S from the slurry tank 42 to the slurry housing 40. The slurry housing 40 includes a slurry port 46 which is positioned in or adjacent the open end of the tube 30 to be cleaned and also includes a lance opening 48 in axial alignment with the slurry port 46.

With continued reference to FIG. 2, illustrated is the preferred method of cleaning the interior wall 32 of the tube 30 according to the present invention. The lance assembly 14 is inserted through the lance opening 48 and the slurry port 46 of the slurry housing 40 before entering the tube 30. The slurry housing 40 seals with the open end of the tube 30 so that the slurry S is generally restrained from draining at this end of the tube 30. The nozzle 18 is advanced into the tube 30 and the fluid F, preferably under high pressure, is pumped through the lance 16 and exits through the jets 22 of the nozzle 18 in a forward direction as shown in FIG. 2. The slurry S is pumped into the slurry housing 40 and exits the slurry housing 40 through the port 46 into the tube 30. The slurry S fills an annular area 36 formed between the interior wall 32 of the tube 30 and the lance 16. The seal formed between the slurry housing 40 and the open end of the tube 30 permits the annular area 36 to generally fill with slurry S along the length of the tube 30 to the nozzle-end 20 of the lance assembly 14 where the high pressure fluid F exits the jets 22 of the nozzle 18. The tube 30 is thus utilized to deliver the slurry S to the nozzle-end 20 of the lance assembly 14. Preferably, the slurry S is pumped at a low pressure to the nozzle-end 20 of the lance assembly 14. The jets 22 of the nozzle 18 direct the high pressure fluid F in a radially forward direction as shown in FIG. 2. The radially forward direction of the high pressure fluid F forms a low pressure area in the annular area 36 at the nozzle 18 immediately behind the forwardly directed high pressure fluid F. The low pressure slurry S in the annular area 36 of the tube 30 is drawn towards the low pressure area at the nozzle 18. The slurry S mixes with the forwardly directed high pressure fluid F at the nozzle 18. The high pressure fluid F acts as a motive force to accelerate the slurry S and causes the slurry S to impinge on the interior wall 32 of the tube 30. Thus, the slurry S is accelerated by the high pressure fluid F and cleans the interior wall 32 of the tube 30 of any stubborn debris. The tubular lance assembly 14 is advanced into the tube 30 while the high pressure fluid F is pumped through the lance assembly 14 and as the slurry S is pumped into the annular area 36. Thus, the cleaning operation is continuous as the lance assembly travels along the length of the tube 30. The cleaning operation may also be performed while withdrawing the tubular lance assembly 14 from the tube 30 by pumping high pressure fluid F through the lance assembly 14 and maintaining slurry S in the annular area 36.

The slurry S may comprise a variety of materials and may be a highly abrasive slurry. The slurry may include a mixture of water and blasting grade sand. Preferably, the solids are a non-silica abrasive material.

In the preferred embodiment, the slurry S is pumped at a pressure in the range of about 20–50 psi and fluid F is pumped at a pressure in the range of about 2,000–10,000 psi.

The description given herein is intended to illustrate the preferred embodiment of the present invention. It is possible for one skilled in the art to make various changes to the details of method without departing from the spirit of this invention. Therefore, it is intended that all such variations be included within the scope of the present invention as described and claimed.

I claim:

1. A method for cleaning the interior wall of a tube with a slurry and a tubular lance, comprising the steps of:

inserting an end of the tubular lance in the tube;

pumping a fluid through the tubular lance and into the tube;

pumping the slurry into an annular area formed between the tubular lance and the interior wall of the tube at the end of the tube being cleaned;

mixing the slurry with the fluid at the end of the tubular lance in the tube; and propelling the slurry and fluid mixture against the interior tube wall at the end of the tubular lance to clean the interior wall of the tube.

2. The method for cleaning of claim 1, further comprising the step of:

advancing the tubular lance within the tube to clean the interior wall of the tube.

3. The method for cleaning of claim 1, wherein the fluid is a high pressure fluid.

4. The method for cleaning of claim 1, wherein the slurry is abrasive.

5. The method for cleaning of claim 1, wherein the slurry pressure is in the range of 20 to 50 pounds per square inch.

6. A method for cleaning the interior wall of a tube with an abrasive slurry and a tubular lance, comprising the steps of:

inserting an end of the tubular lance in the tube;

pumping a high pressure fluid through the tubular lance and into the tube;

pumping the abrasive slurry into an annular area formed between the tubular lance and the interior wall of the tube at the end of the tube being cleaned;

mixing the abrasive slurry with the high pressure fluid at the end of the tubular lance in the tube;

propelling the slurry and fluid mixture against the interior tube wall at the end of the tubular lance to clean the interior wall of the tube; and advancing the tubular lance within the tube to clean the interior wall of the tube.

7. A method for cleaning the interior wall of a tube with a slurry and a tubular lance, comprising the steps of:

inserting an end of the tubular lance in the tube;

pumping a fluid through the tubular lance and into the tube;

pumping the slurry into an annular area formed between the tubular lance and the interior wall of the tube at the end of the tube being cleaned, the slurry pressure being in the range of about 20–50 pounds per square inch;

mixing the slurry with the fluid at the end of the tubular lance in the tube;

propelling the slurry and fluid mixture against the interior tube wall at the end of the tubular lance to clean the interior wall of the tube; and advancing the tubular lance within the tube to clean the interior wall of the tube.

8. The method for cleaning of claim 7, wherein the fluid is a high pressure fluid.

9. The method for cleaning of claim 8, wherein the slurry is abrasive.

* * * * *